US012577076B2

(12) United States Patent
Yanagisawa

(10) Patent No.: US 12,577,076 B2
(45) Date of Patent: Mar. 17, 2026

(54) MEDIUM DISCHARGE DEVICE AND CONTROL METHOD FOR MEDIUM DISCHARGE DEVICE

(71) Applicant: SEIKO EPSON CORPORATION, Tokyo (JP)

(72) Inventor: Hirofumi Yanagisawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 49 days.

(21) Appl. No.: 18/590,281

(22) Filed: Feb. 28, 2024

(65) Prior Publication Data

US 2024/0294350 A1 Sep. 5, 2024

(30) Foreign Application Priority Data

Mar. 1, 2023 (JP) ..... 2023-030798

(51) Int. Cl.

| | |
|---|---|
| ***B65H 31/34*** | (2006.01) |
| ***B65H 31/02*** | (2006.01) |
| ***B65H 31/10*** | (2006.01) |
| ***B65H 43/00*** | (2006.01) |

(52) U.S. Cl.

CPC ..... *B65H 31/34* (2013.01); *B65H 31/02* (2013.01); *B65H 31/10* (2013.01); *B65H 43/00* (2013.01); *B65H 2301/4222* (2013.01); *B65H 2513/10* (2013.01); *B65H 2701/20* (2013.01); *B65H 2801/03* (2013.01)

(58) Field of Classification Search

CPC ..... B65H 31/34; B65H 31/38; B65H 31/40; B65H 33/08; B65H 31/36; B65H 2301/4222; G03G 15/6547; G03G 2215/0089

See application file for complete search history.

(56) References Cited

U.S. PATENT DOCUMENTS 11,492,227 B1 * 11/2022 Sugizaki ..... B65H 31/34
2021/0060933 A1 3/2021 Takahashi

FOREIGN PATENT DOCUMENTS

JP 2021-035870 A 3/2021

* cited by examiner

*Primary Examiner* — Jeremy R Severson
(74) *Attorney, Agent, or Firm* — WORKMAN NYDEGGER

(57) ABSTRACT

A medium discharge device includes a loading stand configured to be loaded with a medium onto which a liquid was ejected by a printing device, a regulation unit that is movable between a regulation position at which a position of the medium discharged to the loading stand is regulated and a retraction position retracted from the regulation position, and a second control unit that controls the movement of the regulation unit. The second control unit determines the retraction position, based on an amount of the liquid ejected onto the medium by the printing device.

13 Claims, 12 Drawing Sheets

MEDIUM DISCHARGE DEVICE AND CONTROL METHOD FOR MEDIUM DISCHARGE DEVICE

The present application is based on, and claims priority from JP Application Serial Number 2023-030798, filed Mar. 1, 2023, the disclosure of which is hereby incorporated by reference herein in its entirety.

BACKGROUND

1. Technical Field

The present disclosure relates to a medium discharge device that discharges a medium, and a control method for the medium discharge device.

2. Related Art

JP-A-2021-35870 describes a medium discharge device on which a medium such as paper discharged from a printing device or the like is loaded. This discharge device is provided with a regulation unit that comes into contact with an end portion of a discharged medium to regulate a position of the medium. The regulation unit is movable between a regulation position at which the medium is regulated and a retraction position retracted outward from the regulation position according to driving of a drive unit including a motor or the like. The regulation unit is located at the retraction position when the medium is discharged to the medium discharging device, and moves to the regulation position after the medium is discharged. The above operation is repeated each time the medium is discharged.

When a distance between the regulation position and the retraction position is increased and an amount of movement of the regulation unit is increased, or when a frequency at which the regulation is performed is high, heat or noise generated from the drive unit increases. Therefore, in the medium discharge device described in JP-A-2021-35870, an amount of movement or a regulation frequency of the regulation unit is adjusted based on a thickness of the medium. For example, when the medium is thick paper, it is easier for the medium to jump out at the time of discharge than when the medium is thin paper, and thus, the amount of movement of the regulation unit is made large, and when the medium is thin paper, the amount of movement of the regulation unit is made small. Further, when the amount of movement of the regulation unit is increased, the regulation frequency is reduced instead, thereby suppressing heat or noise generated by the drive unit.

However, the ease of jump-out of the medium at the time of discharge, that is, the ease of shift of the medium may depend on factors other than the thickness of the medium. Therefore, in a configuration in which the amount of movement of the regulation unit is determined only based on the thickness of the medium, there is concern that the retraction position may be too close to the regulation position and the discharged medium may ride on the regulation unit, or the retraction position may be too far from the regulation position and the amount of movement of the regulation unit may be made larger unnecessarily.

SUMMARY

A medium discharge device includes a loading stand configured to be loaded with a medium onto which a liquid was ejected by a liquid ejection device, a regulation unit configured to move between a regulation position at which a position of the medium discharged to the loading stand is regulated and a retraction position retracted from the regulation position, and a control unit configured to control the movement of the regulation unit, wherein the control unit determines the retraction position, based on an amount of the liquid ejected onto the medium by the liquid ejection device.

A medium discharge device includes a loading stand configured to be loaded with a medium, a regulation unit configured to move between a regulation position at which a position of the medium discharged to the loading stand is regulated and a retraction position retracted from the regulation position, and a control unit configured to control the movement of the regulation unit, wherein the control unit determines the retraction position, based on a discharge speed of the medium discharged to the loading stand.

A control method for a medium discharge device including a loading stand configured to be loaded with a medium onto which a liquid was ejected by a liquid ejection device, and a regulation unit configured to move between a regulation position at which a position of the medium discharged to the loading stand is regulated and a retraction position retracted from the regulation position, the control method including determining the retraction position, based on an amount of the liquid ejected onto the medium by the liquid ejection device.

A control method for a medium discharge device including a loading stand configured to be loaded with a medium, and a regulation unit configured to move between a regulation position at which a position of the medium discharged to the loading stand is regulated and a retraction position retracted from the regulation position, the control method including determining the retraction position, based on a discharge speed of the medium discharged to the loading stand.

DESCRIPTION OF EMBODIMENTS

1. First Embodiment

Hereinafter, a printing system 1 according to a first embodiment will be described with reference to the drawings.

Figure 1:
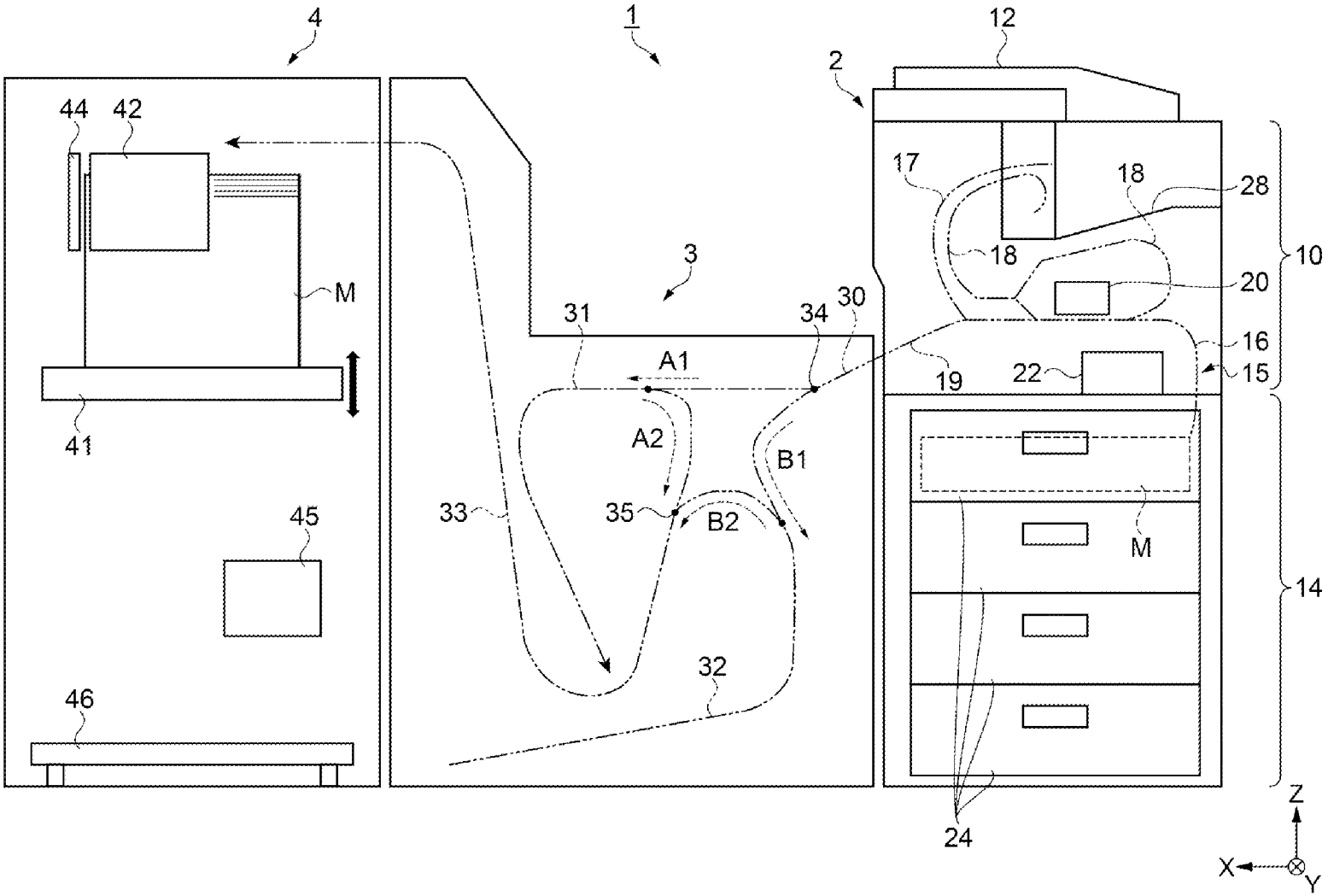
FIG. 1 is a configuration diagram illustrating a schematic configuration of a printing system.

FIG. 1 is a configuration diagram illustrating a schematic configuration of the printing system 1. The printing system 1 is a system that performs printing by ejecting ink, which is an example of a liquid, onto a medium M represented by printing paper.

Each figure illustrates X-, Y-, and Z-axes that intersect with each other. Typically, the X-, Y-, and Z-axes are orthogonal to each other. The X-axis is parallel to an installation surface of the printing system 1 and corresponds to a width direction of the printing system 1. The Y-axis is parallel to the installation surface of the printing system 1 and corresponds to a depth direction of the printing system 1. The Z-axis is perpendicular to the installation surface of the printing system 1 and corresponds to a height direction of the printing system 1.

A +X direction parallel to the X-axis is a direction to the left toward the front of the printing system 1, and a −X direction parallel to the X-axis is a direction opposite to the +X direction. A +Y direction parallel to the Y-axis is a direction from the front to the back of the printing system 1, and a −Y direction parallel to the Y-axis is a direction opposite to the +Y direction. A +Z direction parallel to the Z-axis is an upward direction, and a −Z direction parallel to the Z-axis is a direction opposite to the +Z direction.

The printing system 1 includes a printing device 2, a relay device 3, and a medium discharge device 4 in order in the +X direction. The printing device 2, the relay device 3, and the medium discharge device 4 are mechanically and electrically coupled to each other, and the printing system 1 is configured to convey the medium M from the printing device 2 to the medium discharge device 4.

The printing system 1 is provided with an operating panel (not illustrated) that is operated by an operator. This operating panel is configured to input various settings in the printing device 2, the relay device 3, and the medium discharge device 4.

The printing device 2 is an example of a liquid ejection device, and prints an image based on printing data transmitted from a terminal device 50 (see FIG. 3) or the like onto the conveyed medium M using an inkjet scheme. The medium M is, for example, paper formed as a sheet. The printing device 2 includes a printing unit 10, a scanner unit 12, and a cassette accommodation unit 14.

The printing unit 10 includes a printing head 20 and a first control unit 22, and executes printing for the medium M. The printing head 20 ejects ink onto the medium M under the control of the first control unit 22. Specifically, a plurality of nozzles capable of ejecting ink is formed in the printing head 20, and the printing head 20 selectively ejects the ink from these nozzles, so that an image consisting of a plurality of dots is formed at the medium M. The printing head 20 of the present embodiment is a line head that can eject ink over substantially an entire region in a width direction of the medium M without moving in a ±Y direction, which is the width direction of the medium M.

The first control unit 22 includes a processor (not illustrated) such as a central processing unit (CPU), a storage device (not illustrated) such as a memory, and various interfaces, and controls various operations of the printing device 2. Further, the first control unit 22 controls the overall operation of the printing system 1. That is, the first control unit 22 also controls the operations of the relay device 3 and the medium discharge device 4.

The scanner unit 12 is disposed at an upper portion of the printing device 2, optically reads a set document, generates image data, and stores the generated image data in the memory of the first control unit 22. The scanner unit 12 may be of a flatbed type that reads a document placed on a document table, may be an auto document feeder (ADF) that reads a document to be conveyed, or may include both of these.

The cassette accommodation unit 14 includes a plurality of accommodation cassettes 24. The plurality of accommodation cassettes 24 may accommodate different types of media M, respectively, or accommodate the same type of media M. For the type of medium M, a difference in size, a difference in thickness, a difference in a material, or the like is assumed.

A conveyance path 15 along which the medium M is conveyed is formed in the printing unit 10 and the cassette accommodation unit 14. A plurality of roller pairs (not illustrated) are disposed in the middle of the conveyance path 15. The medium M is conveyed along the conveyance path 15 by drive of a conveyance drive unit 26 (see FIG. 3), which will be described below. The conveyance path 15 includes, for example, a paper feed path 16, a discharge path 17, a reversal path 18, and a sending path 19.

The paper feed path 16 is a path for conveying the medium M from the cassette accommodation unit 14 to the printing head 20, and the discharge path 17 is a path for conveying the medium M printed on by the printing head 20 to a discharge unit 28 provided in the printing device 2. Further, the reversal path 18 is a path for reversing front and back sides of the medium M of which one side has been printed on by the printing head 20 and conveying the medium M to the printing head 20 again when double-sided printing is performed at the medium M. The sending path 19 is a path for sending the medium M printed on by the printing head 20 to the relay device 3 in order for the medium M to be discharged to the medium discharge device 4. Selection as to whether to discharge the medium M after printing to the discharge unit 28 or the medium discharge device 4 is made by a user, and is added to the printing data. That is, the first control unit 22 switches the conveyance path 15 based on the input printing data.

The relay device 3 is disposed between the printing device 2 and the medium discharge device 4, receives the medium M after printing delivered from the sending path 19 through a receiving path 30, and conveys medium M to the medium discharge device 4.

The relay device 3 is provided with two paths for the medium M. A first path is a path from the receiving path 30 to the discharge path 33 via a first switchback path 31. A second path is a path from the receiving path 30 to the discharge path 33 via a second switchback path 32. A plurality of roller pairs (not illustrated) are disposed along these paths.

The first switchback path 31 is a path for receiving the medium M in a direction of an arrow A1 and then switching back the medium M in a direction of an arrow A2. The second switchback path 32 is a path for receiving the medium M in a direction of an arrow B1 and then switching back the medium M in a direction of an arrow B2.

The receiving path 30 branches into the first switchback path 31 and the second switchback path 32 at a branching portion 34. Further, the first switchback path 31 and the second switchback path 32 merge at a merge portion 35. Therefore, the medium M is delivered to the medium discharge device 4 from the common discharge path 33 even when the medium M is sent from the receiving path 30 to which of the paths.

When the printing device 2 continuously performs printing on a plurality of media M, the plurality of media M sent from the printing device 2 to the relay device 3 are alternately sent to a path passing through the first switchback path 31 and a path passing through the second switchback path 32. This makes it possible to increase throughput of medium conveyance in the relay device 3.

The printing system 1 can also have a configuration in which the relay device 3 is omitted. That is, the printing system 1 can have a configuration in which the printing device 2 is coupled to the medium discharge device 4, and the medium M after printing in the printing device 2 is directly sent to the medium discharge device 4 without passing through the relay device 3.

As in the embodiment, since in the configuration in which the medium M after printing in the printing device 2 is sent to the medium discharge device 4 through the relay device 3, a conveyance distance of the medium M or a conveyance time of the medium M is longer than that in a configuration in which the medium M after printing in the printing device 2 is sent to the medium discharge device 4 without going through the relay device 3, it is possible to further dry the ink absorbed by the medium M sent to the medium discharge device 4. Therefore, the relay device 3 has a role of drying the ink absorbed by the medium M.

In the discharge path 33, the medium M is conveyed approximately in the +Z direction, and then is discharged in the +X direction from the relay device 3 and received by the medium discharge device 4. That is, a discharge direction of the medium M to be discharged to the medium discharge device 4 is the +X direction.

Figure 2:
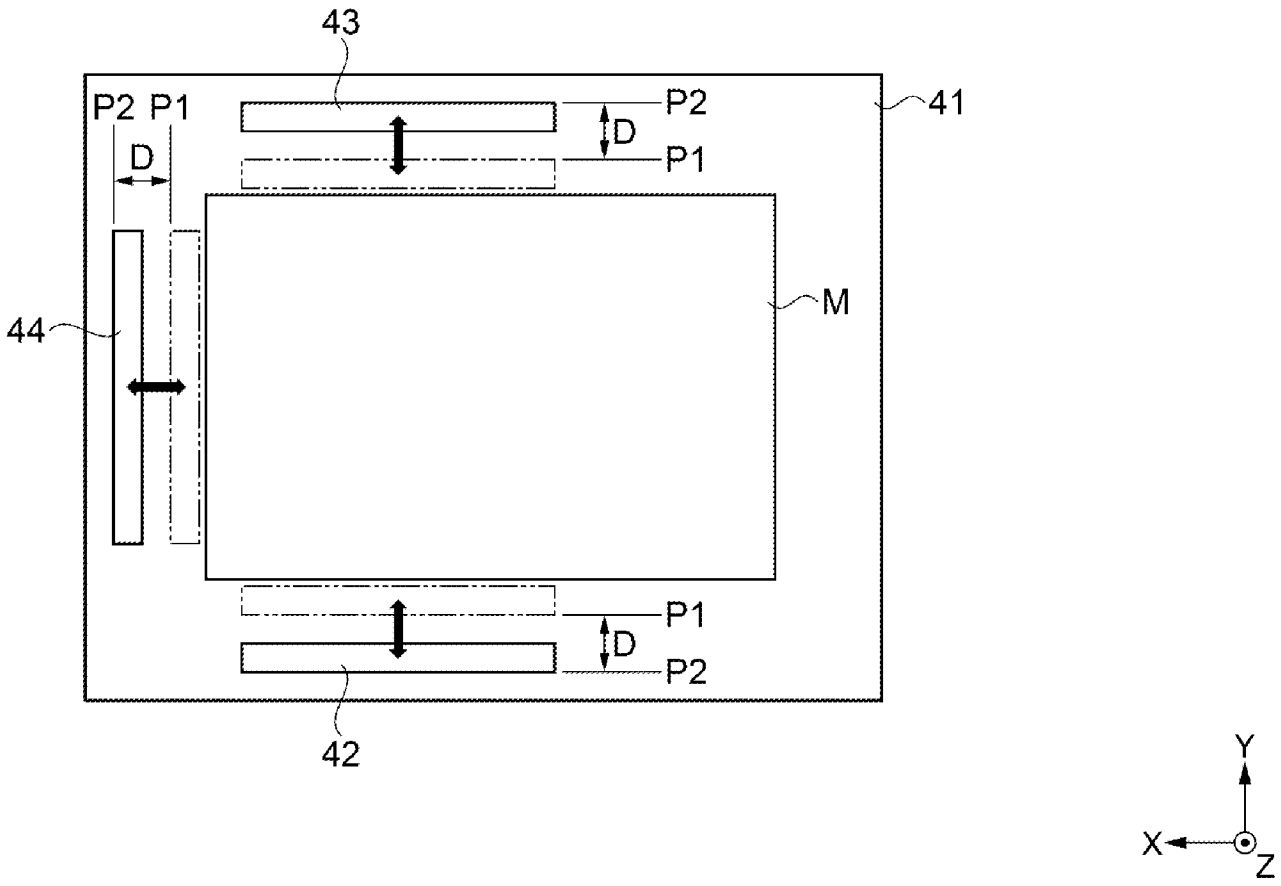
FIG. 2 is a plan view of the inside of the medium discharge device seen from above.

FIG. 2 is a plan view of the inside of the medium discharge device 4 viewed from above.

As illustrated in FIGS. 1 and 2, the medium discharge device 4 includes a loading stand 41, side end regulation units 42 and 43, a rear end regulation unit 44, a second control unit 45, and a cart 46. As described above, the medium M printed on by the printing device 2, that is, the medium M onto which the ink has been discharged by the printing device 2 is discharged to the medium discharge device 4 through the relay device 3.

The medium M discharged to the medium discharge device 4 enters the medium discharge device 4 from the relay device 3 in the +X direction. The medium M lands on the loading stand 41 and is loaded on the loading stand 41. The loading stand 41 can move up and down in the ±Z direction according to drive of a lift drive unit 47 (see FIG. 3), which will be described below, and moves down as the number of sheets of the medium M to be loaded increases. The cart 46 is disposed near the installation surface below the loading stand 41, that is, in the −Z direction. When the medium M loaded on the loading stand 41 is taken out from the medium discharge device 4, the loading stand 41 is moved down by the lift drive unit 47 and placed on the cart 46. The medium M is taken out from the medium discharge device 4 by the cart 46 together with the loading stand 41. The cart 46 is not an essential component. Further, the loading stand 41 may have a configuration in which the loading stand 41 cannot move up or down.

As illustrated in FIG. 2, the side end regulation units 42 and 43 and the rear end regulation unit 44 are disposed on the loading stand 41. The side end regulation units 42 and 43 are plate-like members substantially parallel to an XZ plane, and are disposed in the discharge direction of the medium M, that is, the +X direction, which is the direction in which the medium M is discharged. The side end regulation unit 42 is disposed on the −Y side of the medium M loaded on the loading stand 41, and the side end regulation unit 43 is disposed on the +Y side of the medium M loaded on the loading stand 41. That is, the side end regulation units 42 and 43 are disposed on the loading stand 41 in a direction orthogonal the discharge direction in which the medium M is discharged, relative to a position at which the medium M is loaded.

The rear end regulation unit 44 is a plate-shaped member substantially parallel to a YZ plane, and is disposed in the ±Y direction orthogonal to the +X direction, which is the discharge direction of the medium M. The rear end regulation unit 44 is disposed on the +X side, which is downstream in the discharge direction, relative to the medium M loaded on the loading stand 41. That is, the rear end regulation unit 44 is disposed in the discharge direction in which the medium M is discharged, relative to the position at which the medium M is loaded.

The side end regulation units 42 and 43 and the rear end regulation unit 44 are configured to move between a regulation position P1 close to the medium M and a retraction position P2 spaced apart from the medium M according to drive of a regulation drive unit 48 (see FIG. 3), which will be described below. Specifically, the side end regulation units 42 and 43 are movable in the ±Y direction, and the rear end regulation unit 44 is movable in the ±X direction. In FIG. 2, the side end regulation units 42 and 43 and the rear end regulation unit 44 located at the retraction position P2 are indicated by a solid line, and the side end regulation units 42 and 43 and the rear end regulation unit 44 located at the regulation position P1 are indicated by a two-dot dashed line.

The regulation position P1 is a position that comes into contact with the end portion of the medium M to regulate a position and posture of the medium M, and the retraction position P2 is a position retracted from the regulation position P1, that is, a position moved in a direction away from the medium M. In the present embodiment, a distance D between the regulation position P1 and the retraction position P2, that is, amounts of movement of the side end regulation units 42 and 43 and the rear end regulation unit 44 when these move between the regulation position P1 and the retraction position P2 are the same. That is, the retraction position P2 of the side end regulation unit 42 is located in the −Y direction by the distance D relative to the regulation position P1 of the side end regulation unit 42. The retraction position P2 of the side end regulation unit 43 is located in the +Y direction by the distance D relative to the regulation position P1 of the side end regulation unit 43. Further, the retraction position P2 of the rear end regulation unit 44 is located in the +X direction by the distance D relative to the regulation position P1 of the rear end regulation unit 44.

The regulation position P1 is determined according to the size of the medium M. On the other hand, the retraction position P2 changes depending on factors other than the size of the medium M. That is, even when the size of the medium M is constant, the distance D between the regulation position P1 and the retraction position P2 is not constant. A method for determining the retraction position P2, that is, the distance D will be described below. From now on, when the side end regulation units 42 and 43 and the rear end regulation unit 44 are not distinguished, they will also simply be referred to as regulation units 42, 43, and 44.

The regulation units 42, 43, and 44 are normally located at the retraction position P2. When the regulation of the position of the medium M on the loading stand 41 is performed, the regulation units 42, 43, and 44 move from the retraction position P2 to the regulation position P1, and then return to the retraction position P2. That is, the regulation operation in the regulation units 42, 43, and 44 is a reciprocating operation of moving from the retraction position P2 to the regulation position P1 and returning to the retraction position P2.

The regulation units 42, 43, and 44 are disposed independently of the loading stand 41, and do not move up and down according to drive of the lift drive unit 47. That is, positions of the regulation units 42, 43, and 44 in the ±Z direction are fixed.

Figure 3:
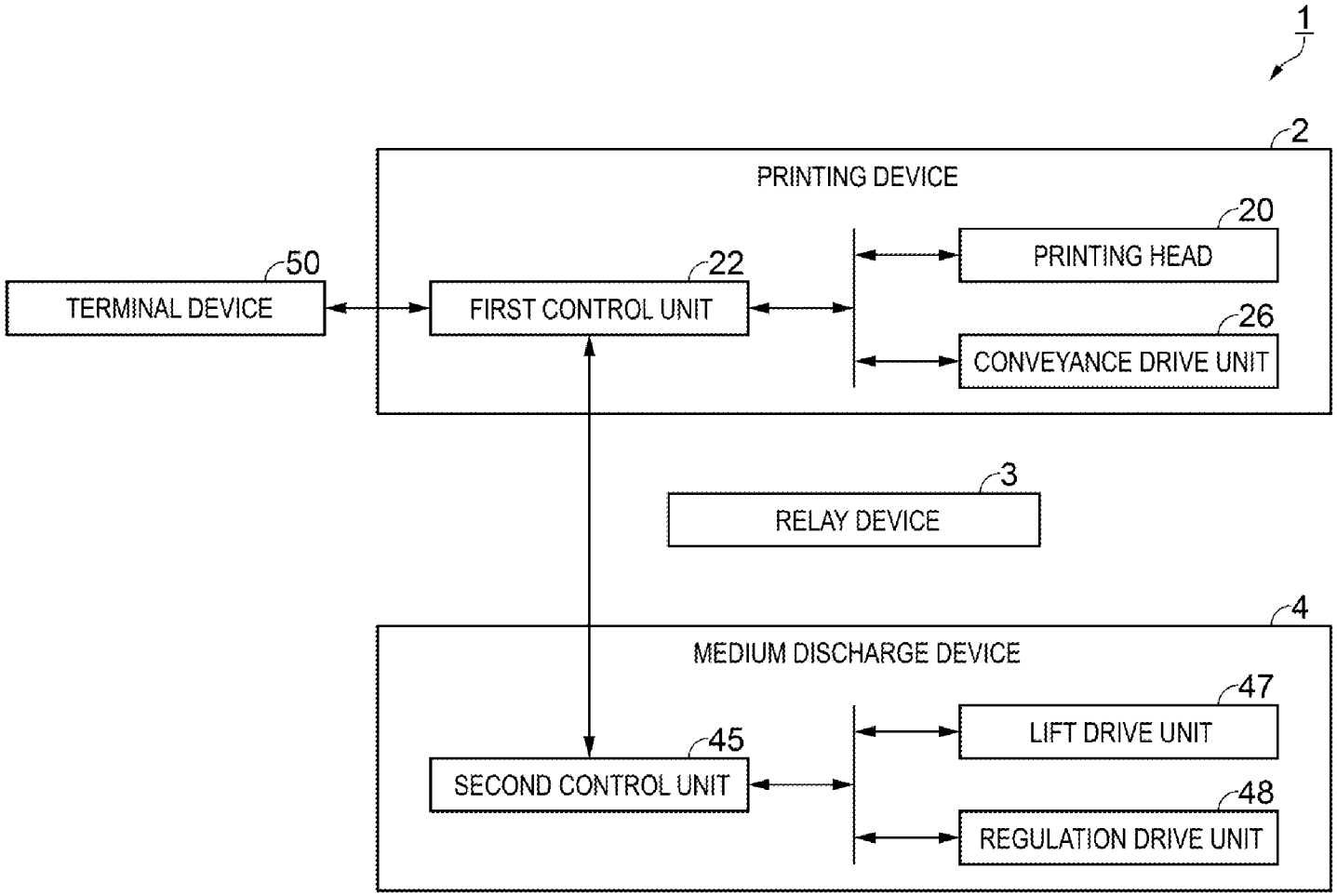
FIG. 3 is a block diagram illustrating a circuit configuration of the printing system.

FIG. 3 is a block diagram illustrating a circuit configuration of the printing system 1.

As illustrated in FIG. 3, the printing device 2 includes the first control unit 22, the printing head 20, and the conveyance drive unit 26.

The conveyance drive unit 26 includes a drive source such as a motor, and rotates a drive roller of the roller pair disposed along the conveyance path 15, based on the control of the first control unit 22. Accordingly, the medium M is conveyed along the conveyance path 15. The first control unit 22 controls the conveyance drive unit 26 and the printing head 20, based on the printing data input from the terminal device 50 or the like, and prints an image based on the printing data on the medium M. The first control unit 22 conveys the medium M after printing toward the discharge unit 28 or the medium discharge device 4.

The medium discharge device 4 includes the second control unit 45, the lift drive unit 47, and the regulation drive unit 48.

The second control unit 45 includes a processor (not illustrated) such as a CPU, a storage device (not illustrated) such as a memory, and various interfaces, and controls various operations of the medium discharge device 4, that is, operations of the lift drive unit 47 and the regulation drive unit 48. Further, the second control unit 45 is also coupled to the first control unit 22 of the printing device 2, and can acquire various types of information from the first control unit 22 based on the printing data input to the first control unit 22 from the terminal device 50.

The lift drive unit 47 includes a drive source such as a motor, and moves the loading stand 41 up and down, based on the control of the second control unit 45. A sensor (not illustrated) that detects that a position in the ±Z direction of the uppermost medium M on the loading stand 41 has reached a predetermined height is disposed in the medium discharge device 4. The second control unit 45 controls the lift drive unit 47 so that the loading stand 41 is moved down by, for example, a height corresponding to a predetermined number of sheets, based on a detection result of this sensor.

The regulation drive unit 48 includes a drive source such as a motor, and moves the regulation units 42, 43, and 44 based on the control of the second control unit 45. The regulation drive unit 48 may be configured such that one drive source drives the side end regulation units 42 and 43 and the rear end regulation unit 44, or a plurality of drive sources drive the side end regulation units 42 and 43 and the rear end regulation unit 44 in a shared manner. The second control unit 45 corresponds to a control unit that controls movement of the regulation units 42, 43, and 44.

Figure 4:
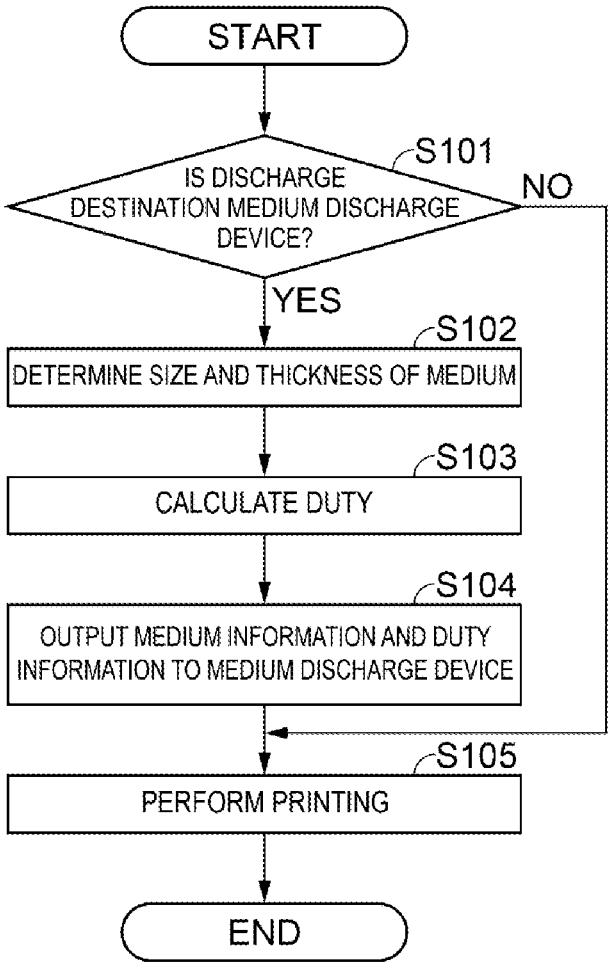
FIG. 4 is a flowchart illustrating an operation of the printing device according to a first embodiment.

FIG. 4 is a flowchart illustrating an operation of the printing device 2.

When the printing data is input to the printing device 2 from the terminal device 50 or the like and the printing on the medium M is instructed, the first control unit 22 of the printing device 2 starts controlling the printing system 1. The input printing data includes various types of information designated by the user, such as information indicating the type of medium M that is a printing target, information indicating a printing mode, and information indicating a discharge destination of the medium M, together with image data representing an image to be printed. Therefore, the first control unit 22 can identify the size of the medium M and the thickness of the medium M based on the printing data.

The printing data includes information for identifying the accommodation cassette 24 accommodating the medium M that is a printing target, but may not include information that enables direct identification of a size or thickness of the medium M. In this case, the accommodation cassette 24 is associated with information indicating the size or thickness of the accommodated medium M in advance, making it possible to identify the size or thickness of the medium M from the printing data. Further, in the present embodiment, it is assumed that there are two levels of thickness of the medium M, and hereinafter, the relatively thicker medium M will be referred to as thick paper, and the relatively thinner medium M will be referred to as thin paper.

As illustrated in FIG. 4, in step S101, the first control unit 22 determines whether the discharge destination of the medium M is the medium discharge device 4 or the discharge unit 28 based on the printing data. The processing proceeds to step S102 when the discharge destination of the medium M is the medium discharge device 4, and to step S105 when the discharge destination is the discharge unit 28.

When the discharge destination of the medium M is the medium discharge device 4 and the processing proceeds to step S102, the first control unit 22 identifies the size and thickness of the medium M that is a printing target, based on the printing data.

In step S103, the first control unit 22 calculates the duty based on the image data included in the printing data. The duty is an index representing the amount of ink ejected onto the medium M, and indicates a ratio of an actual amount ejected to the amount of ink that can be ejected onto the medium M, expressed as a percentage. Here, when the number of printed sheets of the medium M in one printing, that is, in a printing based on one piece of printing data is plural, the first control unit 22 calculates the duty for each medium M.

In step S104, the first control unit 22 outputs control information for notifying that the medium M is scheduled to be discharged to the second control unit 45. Medium information indicating the size and thickness of the medium M, and duty information indicating the calculated duty are included in this control information. When the number of printed sheets of the medium M in one printing is plural, information indicating a duty of each medium M is included in the duty information.

In step S105, the first control unit 22 controls the conveyance drive unit 26 and the printing head 20 based on the printing data, executes conveyance of the medium M and printing of the image, and ends the flow.

Figure 5:
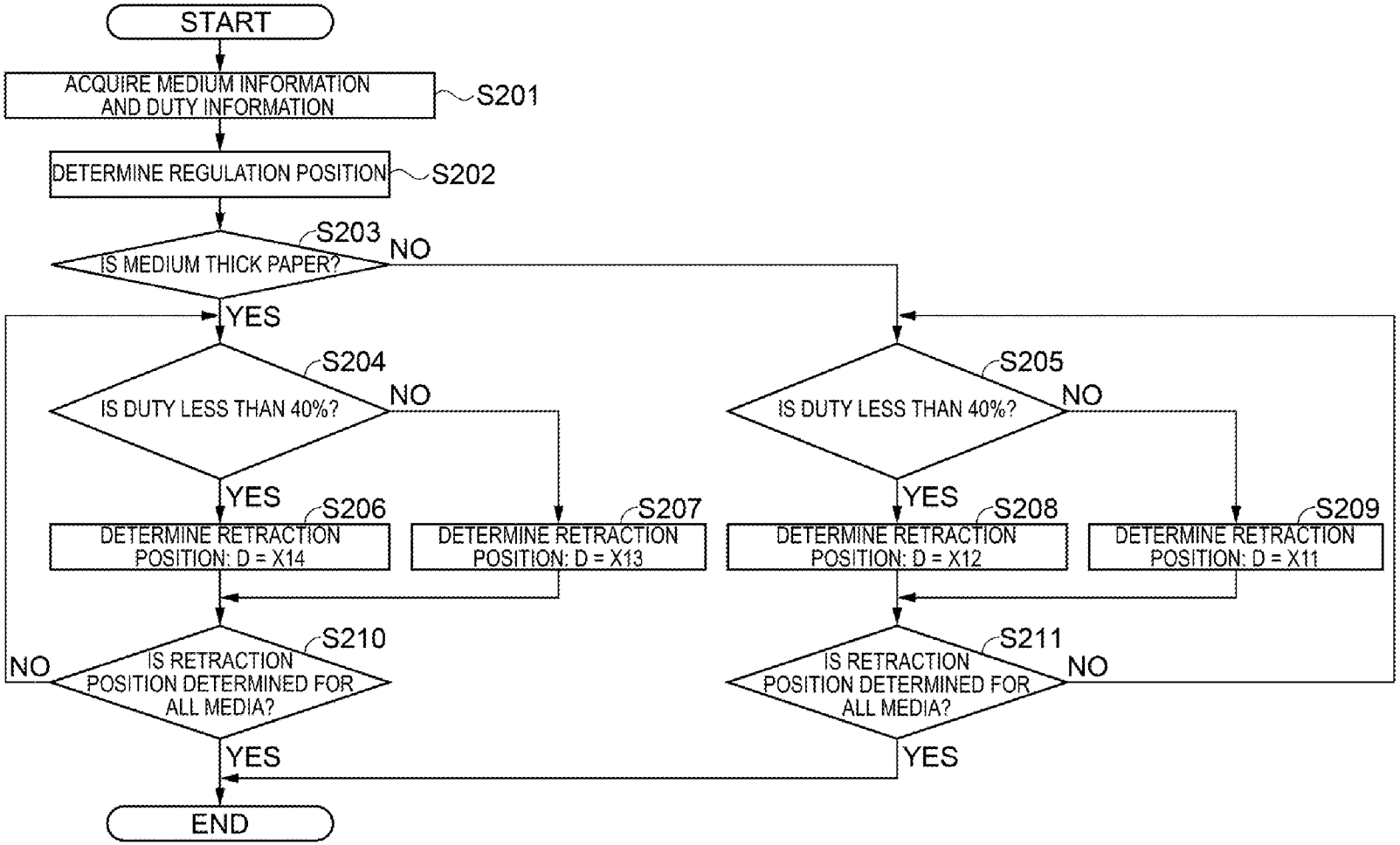
FIG. 5 is a flowchart illustrating an operation of the medium discharge device according to the first embodiment.

FIG. 5 is a flowchart illustrating an operation of the medium discharge device 4, that is, a control method for the medium discharge device 4.

When the second control unit 45 of the medium discharge device 4 receives the control information from the first control unit 22, the second control unit 45 operates according to a flow illustrated in FIG. 5. The second control unit 45 determines the regulation position P1 and the retraction position P2 of the regulation units 42, 43, and 44 based on the input control information. Here, when printing based on the printing data is printing on a plurality of media M, the second control unit 45 determines the retraction position P2 for each medium M.

First, in step S201, the second control unit 45 acquires the medium information and the duty information included in the control information. In step S202, the second control unit 45 determines the regulation positions P1 of the regulation units 42, 43, and 44, based on the size of the medium M represented by the medium information.

Next, in step S203, the second control unit 45 determines whether the medium M scheduled to be discharged is thick paper, based on the medium information. The second control unit 45 proceeds to the processing of step S204 when the medium M is the thick paper, and proceeds to the processing of step S205 when the medium M is thin paper.

When the medium M is thick paper and the processing proceeds to step S204, the second control unit 45 determines whether the duty is less than a predetermined value for each medium M scheduled to be discharged, based on the duty information. In the present embodiment, the second control unit 45 determines whether the duty is less than 40%. The second control unit 45 proceeds to the processing of step S206 when the duty is less than 40%, and proceeds to the processing of step S207 when the duty is 40% or more.

Similarly, even when the medium M is thin paper and the processing proceeds to step S205, the second control unit 45 determines whether the duty is less than 40% for each medium M to be scheduled to be discharged, based on the duty information. The second control unit 45 proceeds to the processing of step S208 when the duty is less than 40%, and proceeds to the processing of step S209 when the duty is 40% or more.

In steps S206 to S209, the second control unit 45 determines the retraction position P2 of the regulation units 42, 43, and 44 for each medium M, based on the thickness of the medium M and the duty. That is, the second control unit 45 determines the amount of movement of the regulation units 42, 43, and 44, that is, the distance D between the regulation position P1 and the retraction position P2 for each medium M. Steps S206 to S209 correspond to a step of determining the retraction position P2.

Specifically, when the medium M is the thick paper, the duty is less than 40%, and the processing proceeds to step S206, the second control unit 45 sets the distance D to X14 and proceeds to the processing of step S210. Further, when the medium M is the thick paper, the duty is 40% or more, and the processing proceeds to step S207, the second control unit 45 sets the distance D to X13 and proceeds to the processing of step S210.

Further, when the medium M is thin paper, the duty is less than 40%, and the processing proceeds to step S208, the second control unit 45 sets the distance D to X12 and proceeds to the processing of step S211. Further, when the medium M is thin paper, the duty is 40% or more, and the processing proceeds to step S209, the second control unit 45 sets the distance D to X11 and proceeds to the processing of step S211.

Here, a relationship X14>X13>X12>X11 is satisfied among X11, X12, X13, and X14. That is, when the thickness of the medium M is relatively large, the second control unit 45 makes the amount of movement of the regulation units 42, 43, and 44 larger than that when the medium M is relatively thin. This is because the thicker medium M has more elasticity, and thus, it is easy for the medium M to jump out at the time of discharge, and to shift on the loading stand 41.

Further, when the duty is relatively low, the second control unit 45 makes the amount of movement of the regulation units 42, 43, and 44 larger than that when the duty is relatively high. This is because, when the duty of the medium M is high, deformation such as wrinkles occurs in the medium M due to the contained ink, and frictional resistance is made high, making it difficult for the medium M to shift on the loading stand 41. A magnitude relationship between X13 and X12 is not limited to the above, and X12 may be greater than X13 or X12 may be equal to X13. The magnitude relationship may be determined as appropriate according to experimental results or the like.

When the processing proceeds to step S210, the second control unit 45 determines whether the retraction position P2 has been determined for all the media M scheduled to be discharged. When the retraction position P2 has been determined for all the media M, the second control unit 45 ends the flow. On the other hand, when the retraction position P2 has not been determined for all the media M, the second control unit 45 returns to the processing of step S204 and determines the retraction position P2 for the next medium M.

Similarly, when the processing proceeds to step S211, the second control unit 45 determines whether the retraction position P2 has been determined for all the media M scheduled to be discharged. When the retraction position P2 has been determined for all the media M, the second control unit 45 ends the flow. On the other hand, when the retraction position P2 has not been determined for all the media M, the second control unit 45 returns to the processing of step S205 and determines the retraction position P2 for the next medium M.

As described above, the second control unit 45 determines the retraction position P2 based on the duty of the medium M, that is, the amount of ink ejected by the printing device 2. Specifically, the second control unit 45 determines the retraction position P2 so that the distance D between the regulation position P1 and the retraction position P2 becomes shorter as the duty of the medium M is higher, that is, as the amount of ink ejected onto the medium M is larger. For example, as illustrated in steps S204, S206, and S207, the second control unit 45 sets the distance D to X14 when the duty is less than 40%, and sets the distance D to X13 smaller than X14 when the duty is 40% or more. Here, an amount of ink ejected onto the medium M when the duty is less than 40% corresponds to a first ejection amount, and the amount of ink ejected onto the medium M when the duty is 40% or more corresponds to the second discharge amount. That is, the second ejection amount is larger than the first ejection amount. Further, X14 corresponds to the first distance, and X13 corresponds to the second distance.

When the retraction position P2 is determined, the second control unit 45 controls the regulation drive unit 48 to cause the regulation units 42, 43, and 44 to move to the retraction position P2 corresponding to the medium M to be discharged first, and waits until the first medium M is discharged. When the first medium M is discharged to the loading stand 41, the second control unit 45 controls the regulation drive unit 48 to cause the regulation units 42, 43, and 44 to execute the regulation operation. In this regulation operation, the second control unit 45 moves the regulation units 42, 43, and 44 from the retraction position P2 to the regulation position P1, and then moves the regulation units 42, 43, and 44 to the retraction position P2 corresponding to the medium M to be discharged next. This operation is repeated from now on.

As described above, according to the medium discharge device 4 and the control method therefor of the present embodiment, it is possible to obtain the following effects.

According to the present embodiment, the second control unit 45 determines the retraction position P2 of the regulation units 42, 43, and 44 based on the duty of the medium M, that is, the amount of ink ejected onto the medium M. Since the ease of the movement of the medium M on the loading stand 41, that is, the ease of the shift of the medium M changes depending on the amount of ink ejected onto the medium M, this configuration makes it possible to determine the retraction position P2 of the regulation units 42, 43, and 44 to be an appropriate position.

Further, according to the present embodiment, when the amount of ink ejected onto the medium M is relatively large, the second control unit 45 makes the retraction position P2 of the regulation units 42, 43, and 44 close to the regulation position P1 and makes the amount of movement of the regulation units 42, 43, and 44 small. When the amount of ink to be ejected is larger, wrinkles occur on a surface of the medium M discharged to the loading stand 41, and the frictional resistance is made high, making movement on the loading stand 41 difficult. Therefore, this configuration makes it possible to determine the retraction position P2 of the regulation units 42, 43, and 44 to be an appropriate position.

In the present embodiment, the second control unit 45 determines the retraction position P2 of the regulation units 42, 43, and 44 based on the thickness of the medium M and the duty, but may determine the retraction position P2 only based on the duty without considering the thickness of the medium M.

2. Second Embodiment

Hereinafter, a printing system 1 according to a second embodiment will be described with reference to the drawings.

A basic configuration of the printing system 1 according to the second embodiment is the same as that of the first embodiment, but an operation of the printing system 1 is different from that in the first embodiment.

In the present embodiment, it is assumed that double-sided printing is performed in the printing device 2, and the second control unit 45 determines the retraction position P2 of the regulation units 42, 43, and 44 based on a difference between a duty on one printing side and a duty on the other printing side, which is the opposite side. Therefore, in the present embodiment, in step S103 (see FIG. 4), the first control unit 22 calculates the duty of each medium M scheduled for printing for each printing side. Information indicating the duty for each printing side of each medium M is included in the duty information output to the medium discharge device 4 in step S104.

Hereinafter, a side directed upward, that is, the +Z direction on the loading stand 41 between the two printing sides of the medium M will be referred to as an upper side, and a side directed downward, that is, the −Z direction will be referred to as a lower side. The upper side corresponds to a first side, and the lower side corresponds to a second side opposite to the first side.

Figure 6:
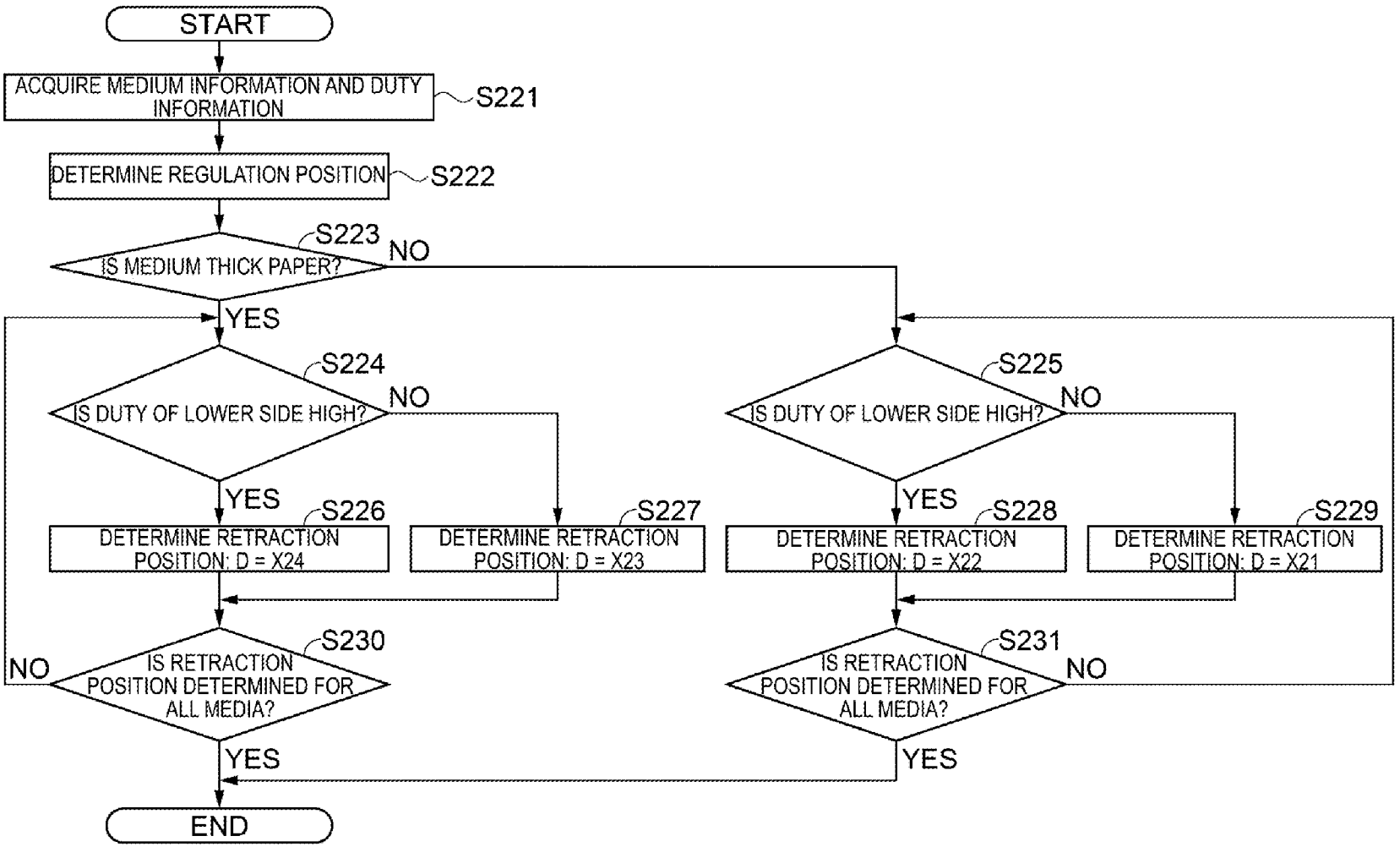
FIG. 6 is a flowchart illustrating an operation of the medium discharge device according to a second embodiment.

FIG. 6 is a flowchart illustrating an operation of the medium discharge device 4 according to the second embodiment.

When the second control unit 45 of the medium discharge device 4 receives the control information from the first control unit 22, the second control unit 45 operates according to a flow illustrated in FIG. 6. The second control unit 45 determines the regulation position P1 and the retraction position P2 of the regulation units 42, 43, and 44 based on the input control information.

First, in step S221, the second control unit 45 acquires the medium information and the duty information included in the control information. In step S222, the second control unit 45 determines the regulation positions P1 of the regulation units 42, 43, and 44, based on the size of the medium M represented by the medium information.

Next, in step S223, the second control unit 45 determines whether the medium M scheduled to be discharged is thick paper, based on the medium information. The second control unit 45 proceeds to the processing of step S224 when the medium M is the thick paper, and proceeds to the processing of step S225 when the medium M is thin paper.

When the medium M is thick paper and the processing proceeds to step S224, the second control unit 45 determines, for each medium M, whether a duty of the lower side is higher than a duty of the upper side, based on the duty information. The second control unit 45 proceeds to the processing of step S226 when the duty of the lower side is higher than the duty of the upper side, and to the processing of step S227 when the duty of the lower side is equal to or lower than the duty of the upper side. The case in which the duty of the lower side is higher than the duty of the upper side corresponds to a case in which a difference between the duty of the lower side and the duty of the upper side, that is, a value obtained by subtracting the duty of the upper side from the duty of the lower side is a positive value. Further, the case in which the duty of the lower side is equal to or lower than the duty of the upper side corresponds to a case in which the difference between the duty of the lower side and the duty of the upper side, that is, the value obtained by subtracting the duty of the upper side from the duty of the lower side is a value equal to or smaller than 0.

Similarly, when the medium M is thin paper and the processing proceeds to step S225, the second control unit 45 determines whether the duty of the lower side is higher than the duty of the upper side, based on the duty information. The second control unit 45 proceeds to the processing of step S228 when the duty of the lower side is higher than the duty of the upper side, and to the processing of step S229 when the duty of the lower side is equal to or lower than the duty of the upper side.

In steps S226 to S229, the second control unit 45 determines the retraction position P2 of the regulation units 42, 43, and 44 for each medium M, based on the thickness of the medium M and a comparison result of the duty of each printing side. That is, the second control unit 45 determines the amount of movement of the regulation units 42, 43, and 44, that is, the distance D between the regulation position P1 and the retraction position P2 for each medium M. Steps S226 to S229 correspond to a step of determining the retraction position P2.

Specifically, when the medium M is the thick paper, the duty of the lower side is higher than the duty of the upper side, and the processing proceeds to step S226, the second control unit 45 sets the distance D to X24 and proceeds to the processing of step S230. Further, when the medium M is the thick paper, the duty of the lower side is equal to or lower than the duty of the upper side, and the processing proceeds to step S227, the second control unit 45 sets the distance D to X23 and proceeds to the processing of step S230.

Further, when the medium M is thin paper, the duty of the lower side is higher than the duty of the upper side, and the processing proceeds to step S228, the second control unit 45 sets the distance D to X22 and proceeds to the processing of step S231. Further, when the medium M is thin paper, the duty of the lower side is equal to or lower than the duty of the upper side, and the processing proceeds to step S229, the second control unit 45 sets the distance D to X21 and proceeds to the processing of step S231.

Here, a relationship X24>X23>X22>X21 is satisfied among X21, X22, X23, and X24. That is, as in the first embodiment, when the thickness of the medium M is relatively large, the second control unit 45 makes the amount of movement of the regulation units 42, 43, and 44 larger than when the medium M is relatively thin.

Further, when the duty of the lower side is higher than the duty of the upper side, the second control unit 45 makes the amount of movement of the regulation units 42, 43, and 44 larger than when the duty of the lower side is equal to or lower than the duty of the upper side. This is because, when the duty of the lower side is higher than the duty of the upper side, the medium M curves and a contact area with the loading stand 41 or the other media M already placed on the loading stand 41 becomes small, making shift on the loading stand 41 easy.

Figure 7A:
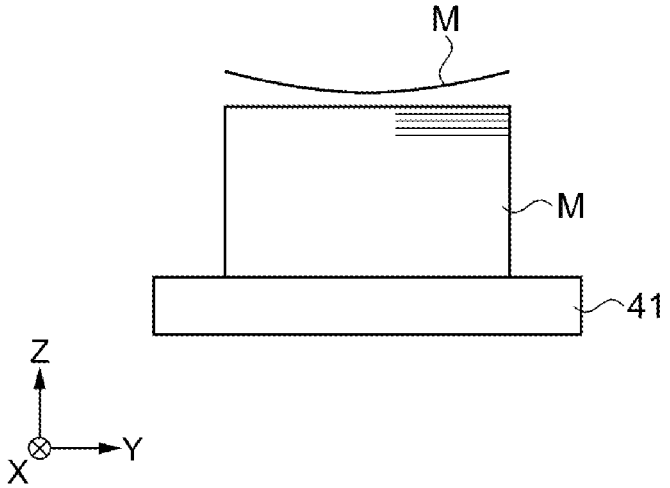
FIG. 7A is an illustrative diagram illustrating a curvature of the medium.
Figure 7B:
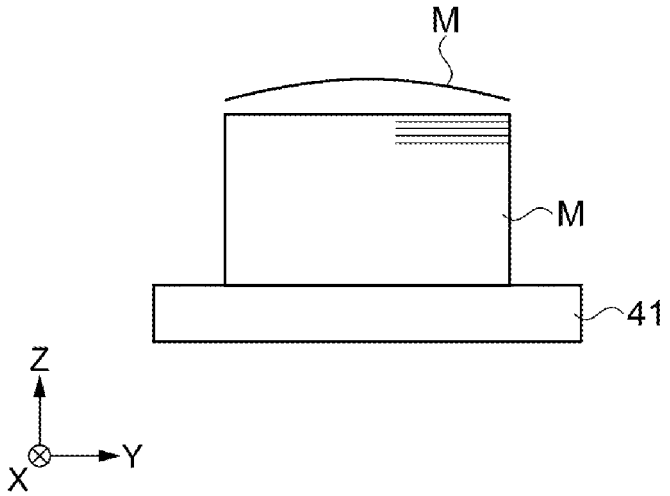
FIG. 7B is an illustrative diagram illustrating the curvature of the medium.

FIGS. 7A and 7B are illustrative diagrams illustrating the curvature of the medium M, and are diagrams of the medium M on the loading stand 41 viewed in the ±X direction.

When the ink is ejected onto the medium M and printing is performed, the printed side of the medium M expands slightly due to impregnation of the ink. When the amount of ink ejected is different between both sides of the medium M, the side with a larger amount ejected, that is, the side with a higher duty further expands, and thus, the medium M curves. When the duty of the lower side is higher than the duty of the upper side, the medium M curves convexly downward, that is, in the −Z direction, as illustrated in FIG. 7A. On the other hand, when the duty of the lower side is lower than the duty of the upper side, the medium M curves convexly upward, that is, in the +Z direction, as illustrated in FIG. 7B. No matter which direction the medium M curves, a contact area with the loading stand 41 or the other medium M on the loading stand 41 becomes smaller. However, when the upward side is convex, the medium M comes into contact with the loading stand 41 or the other medium M at both ends of the medium M in the ±X direction and both ends of the ±Y direction, and thus, it is assumed that it is difficult for the medium M to shift as compared to a case in which the downward side is convex, that is, the end portion of the medium M does not come into contact. For this reason, a magnitude relationship of X21, X22, X23, and X24 is determined as described above. A magnitude relationship between X23 and X22 is not limited to the above, and X22 may be greater than X23 or X22 may be equal to X23. The magnitude relationship may be determined as appropriate according to experimental results or the like.

Returning to FIG. 6, when the processing proceeds to step S230, the second control unit 45 determines whether the retraction position P2 has been determined for all the media M scheduled to be discharged. When the retraction position P2 has been determined for all the media M, the second control unit 45 ends the flow. On the other hand, when the retraction position P2 has not been determined for all the media M, the second control unit 45 returns to the processing of step S224 and determines the retraction position P2 for the next medium M.

Similarly, when the processing proceeds to step S231, the second control unit 45 determines whether the retraction position P2 has been determined for all the media M scheduled to be discharged. When the retraction position P2 has been determined for all the media M, the second control unit 45 ends the flow. On the other hand, when the retraction position P2 has not been determined for all the media M, the second control unit 45 returns to the processing of step S225 and determines the retraction position P2 for the next medium M.

As described above, the second control unit 45 determines the retraction position P2 based on the difference between the duty of the upper side of the medium M and the duty of the lower side, that is, a difference between the amount of ink ejected onto the upper side of the medium M and the amount of ink ejected onto the lower side of the medium M. Specifically, when the duty of the lower side is higher than the duty of the upper side, the second control unit 45 makes the distance D between the regulation position P1 and the retraction position P2 larger than when the duty of the lower side is equal to or lower than the duty of the upper side. In other words, when the amount ejected onto the lower side is larger than the amount ejected onto the upper side, the second control unit 45 makes the distance D between the regulation position P1 and the retraction position P2 larger than when the amount ejected onto the lower side is equal to or smaller than the amount ejected onto the upper side.

When the retraction position P2 is determined, the second control unit 45 controls the regulation drive unit 48 to cause the regulation units 42, 43, and 44 to move to the retraction position P2 corresponding to the medium M to be discharged first, and waits until the first medium M is discharged. When the first medium M is discharged to the loading stand 41, the second control unit 45 controls the regulation drive unit 48 to cause the regulation units 42, 43, and 44 to execute the regulation operation. In this regulation operation, the second control unit 45 moves the regulation units 42, 43, and 44 from the retraction position P2 to the regulation position P1, and then moves the regulation units 42, 43, and 44 to the retraction position P2 corresponding to the medium M to be discharged next. This operation is repeated from now on.

As described above, according to the medium discharge device 4 and the control method therefor of the present embodiment, it is possible to obtain the following effects.

According to the present embodiment, the second control unit 45 determines the retraction position P2 of the regulation units 42, 43, and 44 based on the difference between the duty of the upper side of the medium M and the duty of the lower side, that is, the amount of ink ejected onto the upper side of the medium M and the amount of ink ejected onto the lower side of the medium M. Therefore, even when the ease of the shift of the medium M on the loading stand 41 changes depending on a difference in the ejection amount between the front and back sides of the medium M, it is possible to determine the retraction position P2 of the regulation units 42, 43, and 44 to be an appropriate position.

Further, according to the present embodiment, when the amount ejected onto the lower side is larger than the amount ejected onto the upper side, the second control unit 45 moves the retraction position P2 of the regulation units 42, 43, and 44 away from the regulation position P1, and makes the amount of movement of the regulation units 42, 43, and 44 larger. When the amount ejected onto the lower side is larger, the curvature of the medium M makes it difficult for the end portion of the medium M to come into contact with the loading stand 41 or the other media M on the loading stand 41. This reduces the frictional resistance of the medium M, making it easier for the medium M to move on the loading stand 41. Therefore, this configuration makes it possible to determine the retraction position P2 of the regulation units 42, 43, and 44 to be an appropriate position.

In the present embodiment, the second control unit 45 determines the retraction position P2 of the regulation units 42, 43, and 44 based on the thickness of the medium M and a difference in duty between the printing sides, but may determine the retraction position P2 only based on the difference in duty between the printing sides without considering the thickness of the medium M.

3. Third Embodiment

Hereinafter, a printing system 1 according to a third embodiment will be described with reference to the drawings.

A basic configuration of the printing system 1 according to the third embodiment is the same as that of the first embodiment, but the operation of the printing system 1 is different from that in the first embodiment.

Figure 8:
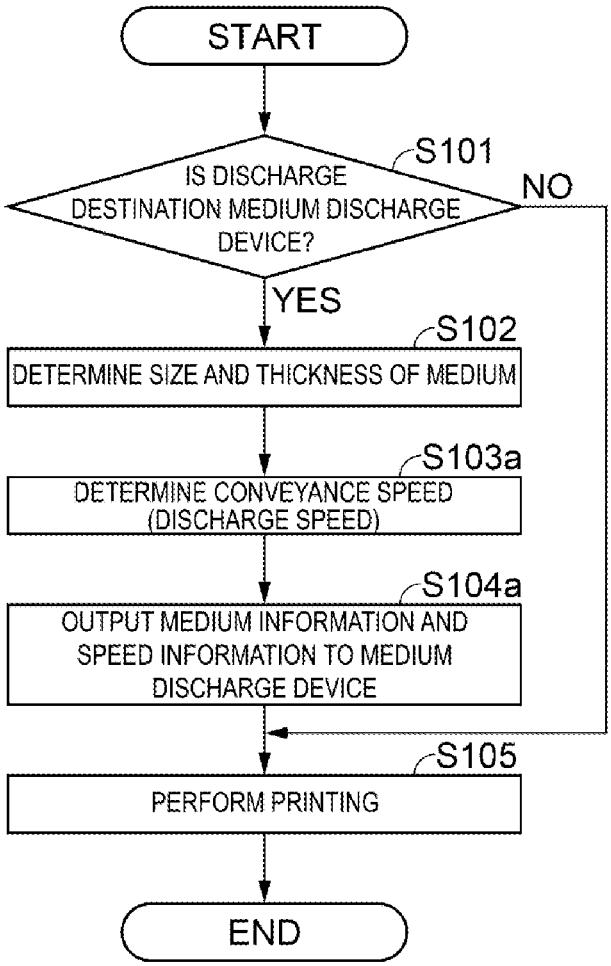
FIG. 8 is a flowchart illustrating an operation of the printing device according to a third embodiment.

FIG. 8 is a flowchart illustrating an operation of the printing device 2 according to the third embodiment.

The present embodiment differs from the first embodiment in that the first control unit 22 executes steps S103*a* and S104*a* instead of steps S103 and S104 in the first embodiment.

In step S103*a*, the first control unit 22 identifies a conveyance speed of the medium M based on the information indicating the printing mode included in the printing data. Here, the first control unit 22 can identify whether the conveyance speed of the medium M is high based on the printing mode selected by the user. For example, when the user selects a printing mode in which a throughput is prioritized, the medium M is conveyed at a relatively high speed, and when the user selects a printing mode in which image quality is prioritized or a printing mode in which low noise is prioritized, the medium M is conveyed at a relatively low speed. In the present embodiment, even when the number of printed sheets of the medium M in one printing is plural, the conveyance speeds of all media M are the same. Therefore, it is not necessary to identify the conveyance speed for each medium M. That is, the number of conveyance speeds to be identified may be one. Further, when the medium M after printing is discharged to the medium discharge device 4, the medium M is discharged at approximately the same speed as the conveyance speed, and thus identifying the conveyance speed is synonymous with identifying the discharge speed of the medium M when the medium M is discharged to the loading stand 41.

In step S104*a*, the first control unit 22 outputs the control information for notifying that the medium M is scheduled to be discharged to the second control unit 45. In the present embodiment, the control information includes the medium information indicating the size of the medium M, and speed information indicating the identified discharge speed. In addition to the above information, the control information may also include information indicating the number of printed sheets, that is, the number of sheets of the medium M required when printing based on the printing data is performed.

Figure 9:
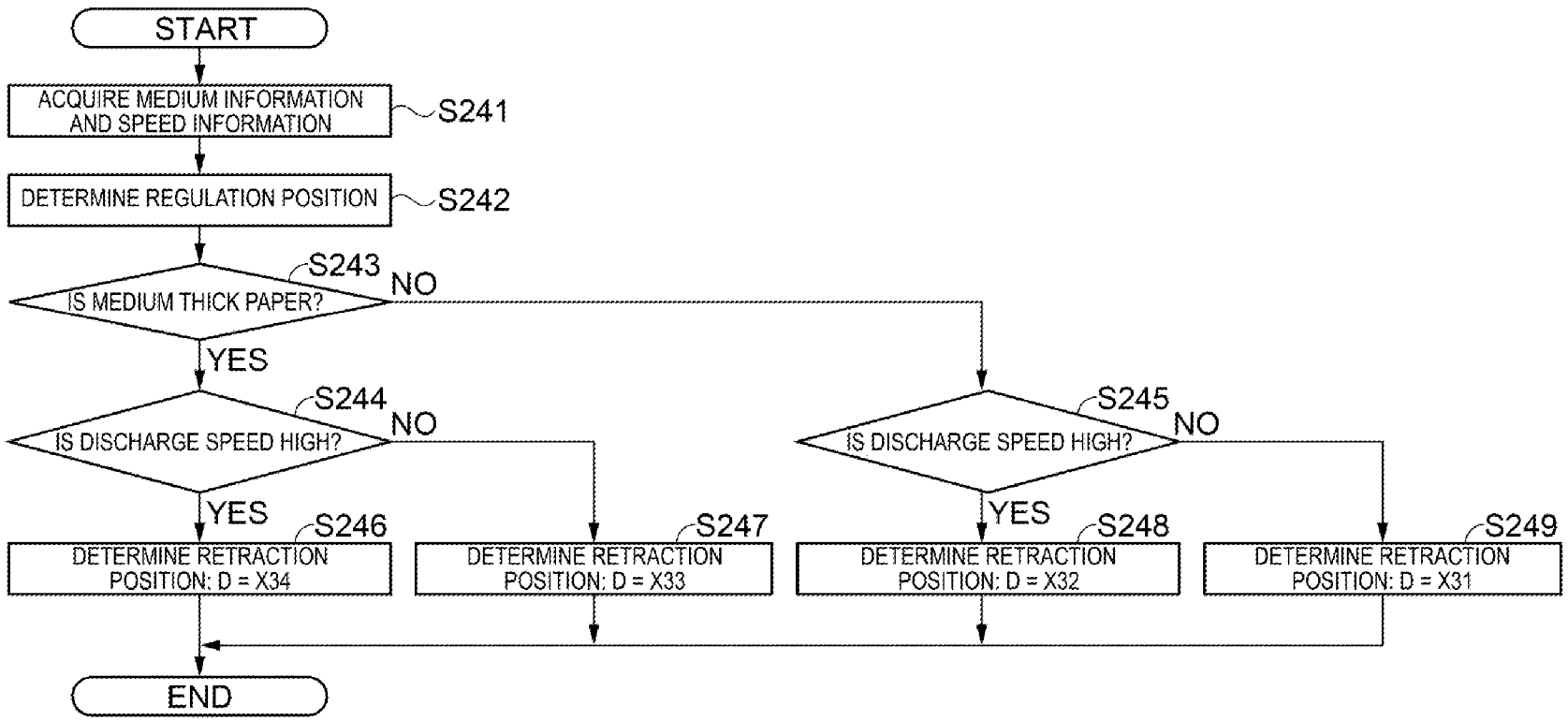
FIG. 9 is a flowchart illustrating an operation of the medium discharge device according to the third embodiment.

FIG. 9 is a flowchart illustrating an operation of the medium discharge device 4 according to the third embodiment.

When the second control unit 45 of the medium discharge device 4 receives control information from the first control unit 22, the second control unit 45 operates according to a flow illustrated in FIG. 9. The second control unit 45 determines the regulation position P1 and the retraction position P2 of the regulation units 42, 43, and 44 based on the input control information.

First, in step S241, the second control unit 45 acquires the medium information and speed information included in the control information. In step S242, the second control unit 45 determines the regulation positions P1 of the regulation units 42, 43, and 44, based on the size of the medium M represented by the medium information.

Next, in step S243, the second control unit 45 determines whether the medium M scheduled to be discharged is thick paper, based on the medium information. The second control unit 45 proceeds to the processing of step S244 when the medium M is the thick paper, and proceeds to the processing of step S245 when the medium M is thin paper.

When the medium M is the thick paper and the processing proceeds to step S244, the second control unit 45 determines whether the discharge speed of the medium M scheduled to be discharged is high, based on the speed information. The second control unit 45 proceeds to the processing of step S246 when the discharge speed is relatively high, and proceeds to the processing of step S247 when the discharge speed is relatively low.

Similarly, when the medium M is the thin paper and the processing proceeds to step S245, the second control unit 45 determines whether the discharge speed of the medium M scheduled to be discharged is high, based on the speed information. The second control unit 45 proceeds to the processing of step S248 when the discharge speed is relatively high, and proceeds to the processing of step S249 when the discharge speed is relatively low.

In steps S246 to S249, the second control unit 45 determines the retraction position P2 of the regulation units 42, 43, and 44, based on the thickness of the medium M and the discharge speed. That is, the second control unit 45 determines the amount of movement of the regulation units 42, 43, and 44, that is, the distance D between the regulation position P1 and the retraction position P2, and ends the processing. Steps S246 to S249 correspond to a step of determining the retraction position P2.

Specifically, when the medium M is the thick paper, the discharge speed is high, and the processing proceeds to step S246, the second control unit 45 sets the distance D to X34. Further, when the medium M is the thick paper, the discharge speed is low, and the processing proceeds to step S247, the second control unit 45 sets the distance D to X33. Further, when the medium M is the thin paper, the discharge speed is high, and the processing proceeds to step S248, the second control unit 45 sets the distance D to X32. When the medium M is the thin paper, the discharge speed is low and the processing proceeds to step S249, the second control unit 45 sets the distance D to X31.

Here, a relationship X34>X33>X32>X31 is satisfied among X31, X32, X33, and X34. That is, as in the first embodiment, when the thickness of the medium M is relatively large, the second control unit 45 makes the amount of movement of the regulation units 42, 43, and 44 larger than when the medium M is relatively thin.

Further, when the discharge speed is relatively high, the second control unit 45 makes the amount of movement of the regulation units 42, 43, and 44 larger than when the discharge speed is relatively low. This is because, when the discharge speed is high, it is easy for the medium M to jump out at the time of discharge and to shift on the loading stand 41. A magnitude relationship between X33 and X32 is not limited to the above, and X32 may be greater than X33 or X32 may be equal to X33. The magnitude relationship may be determined as appropriate according to experimental results or the like.

As described above, the second control unit 45 determines the retraction position P2 based on the discharge speed of the medium M. Specifically, the second control unit 45 determines the retraction position P2 so that, when the discharge speed of the medium M is lower, the distance D between the regulation position P1 and the retraction position P2 is smaller. For example, as illustrated in steps S244, S246, and S247, the second control unit 45 sets the distance D to X34 when the discharge speed is high, and sets the distance D to X33 smaller than X34 when the discharge speed is low. Here, the discharge speed when the speed is high corresponds to a first speed, and the discharge speed when the speed is low corresponds to a second speed. That is, the second speed is lower than the first speed. Further, X34 corresponds to a third distance, and X33 corresponds to a fourth distance.

When the retraction position P2 is determined, the second control unit 45 controls the regulation drive unit 48 to cause the regulation units 42, 43, and 44 to move to the determined retraction position P2, and waits for the medium M to be discharged. The second control unit 45 controls the regulation drive unit 48 to cause the regulation units 42, 43, and 44 to execute the regulation operation each time the medium M is discharged to the loading stand 41.

As described above, according to the medium discharge device 4 and the control method therefor of the present embodiment, it is possible to obtain the following effects.

According to the present embodiment, the second control unit 45 determines the retraction position P2 of the regulation units 42, 43, and 44 based on the discharge speed of the medium M discharged to the loading stand 41. Since the ease of the movement of the medium M on the loading stand 41, that is, the ease of the shift of the medium M changes depending on the discharge speed of the medium M, this configuration makes it possible to determine the retraction position P2 of the regulation units 42, 43, and 44 to be an appropriate position.

Further, according to the present embodiment, when the discharge speed of the medium M is relatively low, the second control unit 45 makes the retraction position P2 of the regulation units 42, 43, and 44 close to the regulation position P1 and makes the amount of movement of the regulation units 42, 43, and 44 small. When the discharge speed of the medium M discharged to the loading stand 41 is low, the movement on the loading stand 41 is difficult, and thus, this configuration makes it possible to determine the retraction position P2 of the regulation units 42, 43, and 44 to be an appropriate position.

In the present embodiment, the second control unit 45 determines the retraction position P2 of the regulation units 42, 43, and 44 based on the thickness of the medium M and the discharge speed, but may determine the retraction position P2 only based on the discharge speed without considering the thickness of the medium M.

Further, an aspect in which an operation in which the first embodiment and the third embodiment are combined or an operation in which the second embodiment and the third embodiment are combined is performed may be adopted. That is, the second control unit 45 may determine the retraction position P2 of the regulation units 42, 43, and 44, based on the duty for each medium M or each printing side of each medium M, and the discharge speed.

4. Fourth Embodiment

Hereinafter, a printing system 1 according to a fourth embodiment will be described with reference to the drawings.

A basic configuration of the printing system 1 according to the fourth embodiment is the same as that of the third embodiment, except that the operation of the printing system 1 is different from that in the third embodiment. Specifically, in the fourth embodiment, the medium discharge device 4 determines the regulation frequency of the regulation units 42, 43, and 44, that is, the frequency at which the regulation units 42, 43, and 44 perform the regulation, in addition to determining the regulation position P1 and the retracting position P2 of the regulation units 42, 43, and 44 based on the control information input from the printing device 2.

Figure 10:
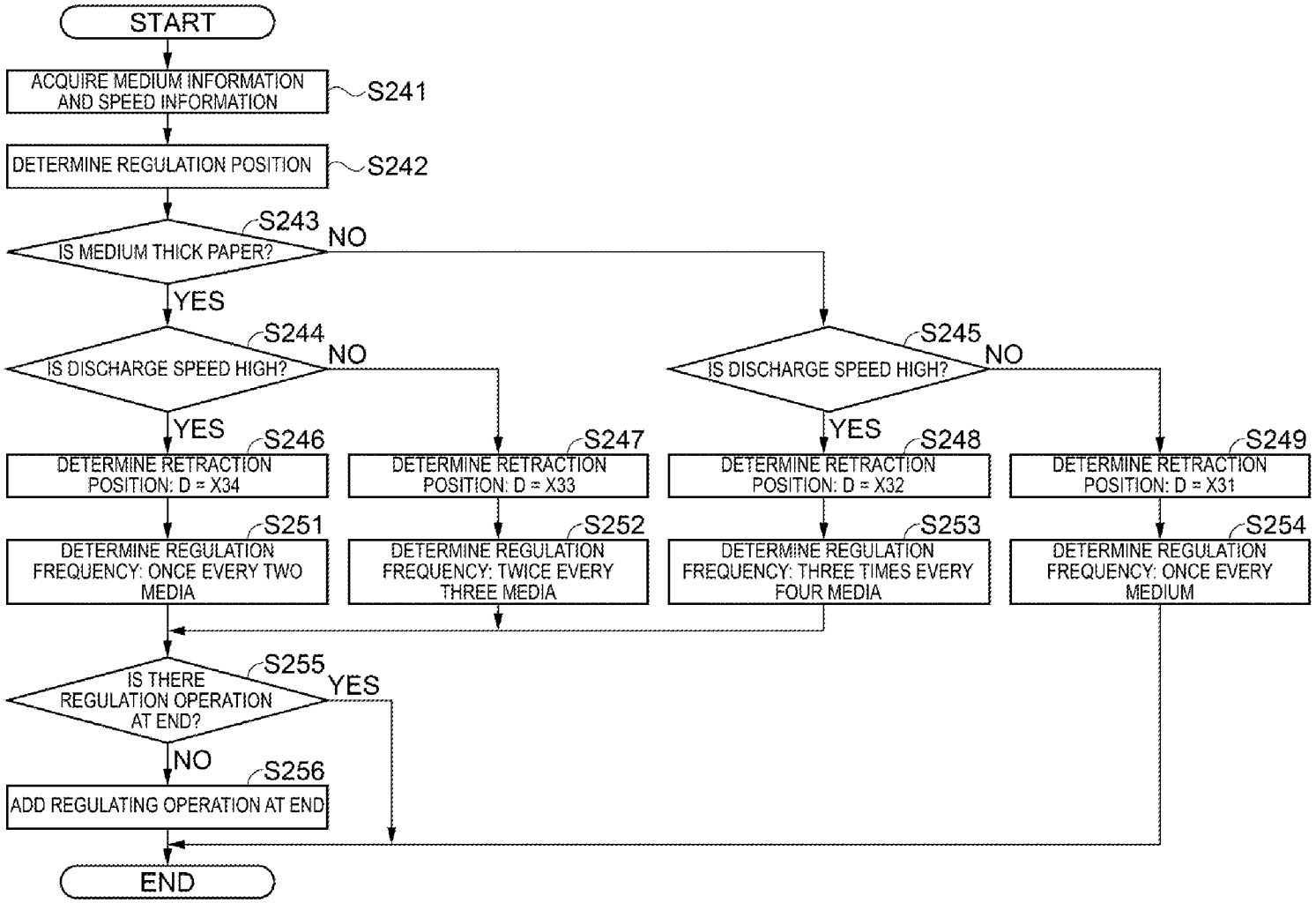
FIG. 10 is a flowchart illustrating an operation of the medium discharge device according to a fourth embodiment.

FIG. 10 is a flowchart illustrating an operation of the medium discharge device 4 according to the fourth embodiment. Here, steps S241 to S249 are the same as those in the third embodiment, and operations of steps S251 to S256 are added to the third embodiment.

Steps S251 to S254 are steps of determining the regulation frequency. Specifically, in step S251 after the distance D, which is the amount of movement of the regulation units 42, 43, and 44, is determined to be X34, the second control unit 45 determines the regulation frequency to be once every two sheets. Further, in step S252 after the distance D is determined to be X33, the second control unit 45 determines the regulation frequency to be twice every three sheets. Further, in step S253 after the distance D is determined to be X32, the second control unit 45 determines the regulation frequency to be three times every four sheets. in step S254 after the distance D is determined to be X31, the second control unit 45 determines the regulation frequency to be once every sheet.

As described above, a relationship X34>X33>X32>X31 is satisfied for the distance D, which is the amount of movement of the regulation units 42, 43, and 44. That is, the second control unit 45 reduces the regulation frequency as the amount of movement of the regulation units 42, 43, and 44 increases. This is because heat or noise generated by the regulation drive unit 48 increase as the amount of movement of the regulation units 42, 43, and 44 increases, and thus, the regulation frequency decreases to suppress the generated heat or noise.

When the regulation frequency is determined as described above, the regulation operation may not be performed after the last medium M is discharged, depending on a relationship between the regulation frequency and the number of printed sheets. However, the regulation operation may be performed after the last medium M is discharged. Therefore, in steps S255 and S256, when the regulation operation is scheduled not to be performed after the last medium M is discharged, the processing of adding the regulation operation is executed. However, when the regulation frequency is determined to be once every sheet in step S254, there is no need to add the regulation operation, and thus, the second control unit 45 ends the flow without executing steps S255 and S256.

In step S255, the second control unit 45 determines whether the regulation operation is scheduled to be performed after the last medium M is discharged, based on the determined regulation frequency and the number of printed sheets. When the regulation operation is not scheduled to be performed at the end, the second control unit 45 proceeds to the processing of step S256. On the other hand, when the regulation operation is scheduled to be performed at the end, the second control unit 45 ends the flow without executing step S256.

When the regulation operation is not scheduled to be performed at the end and the processing proceeds to step S256, the second control unit 45 changes the schedule so that the regulation operation is additionally performed after the last medium M is discharged, and ends the flow. In the present embodiment, the presence or absence of the regulation operation after the last medium M is discharged is determined based on the number of printed sheets, and thus it is necessary to add information indicating the number of printed sheets to the control information output to the medium discharge device 4 in step S104*a* described in the third embodiment.

As described above, the second control unit 45 determines the regulation frequency, that is, a frequency at which the regulation units 42, 43, and 44 are moved from the retraction position P2 to the regulation position P1, based on the discharge speed of the medium M. Specifically, the second control unit 45 reduces the regulation frequency as the discharge speed of the medium M is higher. For example, as illustrated in steps S244, S251, and S252, the second control unit 45 sets the regulation frequency to twice every three sheets when the discharge speed is low, and sets the regulation frequency to once every two sheets when the discharge speed is high. Here, the discharge speed when the discharge speed is low corresponds to the first speed, and the discharge speed when the discharge speed is high corresponds to the second speed. That is, the second speed is higher than the first speed. Further, the regulation frequency of twice every three sheets corresponds to a first frequency, and the regulation frequency of once every two sheets corresponds to a second frequency. That is, the second frequency is lower than the first frequency.

When the retraction position P2 is determined, the second control unit 45 controls the regulation drive unit 48 to cause the regulation units 42, 43, and 44 to move to the determined retraction position P2, and waits for the medium M to be discharged. When the medium M starts to be discharged to the loading stand 41, the second control unit 45 controls the regulation drive unit 48 to cause the regulation units 42, 43, and 44 to execute regulation operations based on the determined regulation frequency. Further, when the regulation operation is added in step S256, the second control unit 45 controls the regulation drive unit 48 so that the regulation operation is additionally executed, after the last medium M is discharged.

As described above, according to the medium discharge device 4 and the control method therefor of the present embodiment, it is possible to obtain the following effects.

According to the present embodiment, the second control unit 45 determines the retraction position P2 and the regulation frequency of the regulation units 42, 43, and 44 based on the discharge speed of the medium M. That, the regulation frequency of the regulation units 42, 43, and 44 can be determined according to the retraction position P2, that is, the amount of movement of the regulation units 42, 43, and 44, it is possible to appropriately adjust heat or noise generated according to the movement of the regulation units 42, 43, and 44.

Further, according to the present embodiment, when the discharge speed of the medium M is relatively high, that is, when the amount of movement of the regulation units 42, 43, and 44 is relatively large, the second control unit 45 reduces the regulation frequency of the regulation unit 42, 43 and 44. Therefore, it is possible to suppress heat or noise, which increases with a large amount of movement, by reducing the regulation frequency.

5. Modification Example

Each of the embodiments may be modified as follows.

In each of the embodiments described above, an amount of movement of the side end regulation units 42 and 43 is equal to an amount of movement of the rear end regulation unit 44, but the amounts of movement may be different from each other. Further, the amount of movement of the side end regulation units 42 and 43 may be always constant, and only the amount of movement of the rear end regulation unit 44 may be determined depending on the duty, discharge speed, or the like. Alternatively, the amount of movement of the rear end regulation unit 44 may be always constant, and only the amounts of movement of the side end regulation units 42 and 43 may be determined depending on the duty, discharge speed, or the like. Further, the medium discharge device 4 does not need to include all of the regulation units 42, 43, and 44, and only needs to include at least one of the regulation units 42, 43, and 44.

In the first embodiment described above, the second control unit 45 determines the retraction position P2 of the regulation units 42, 43, and 44, that is, the amount of movement of the regulation units 42, 43, and 44, based on the duty of the medium M to be discharged, but the present disclosure is not limited to this configuration. For example, the duty of the medium M immediately previously discharged to the loading stand 41, that is, the uppermost medium M on the loading stand 41 also affects the frictional resistance of the medium M to be discharged next, that is, the ease of the shift. Therefore, the second control unit 45 may determine the amount of movement of the regulation units 42, 43, and 44 based on the duty of the immediately previous discharged medium M and the duty of the medium M to be discharged next.

Figure 11:
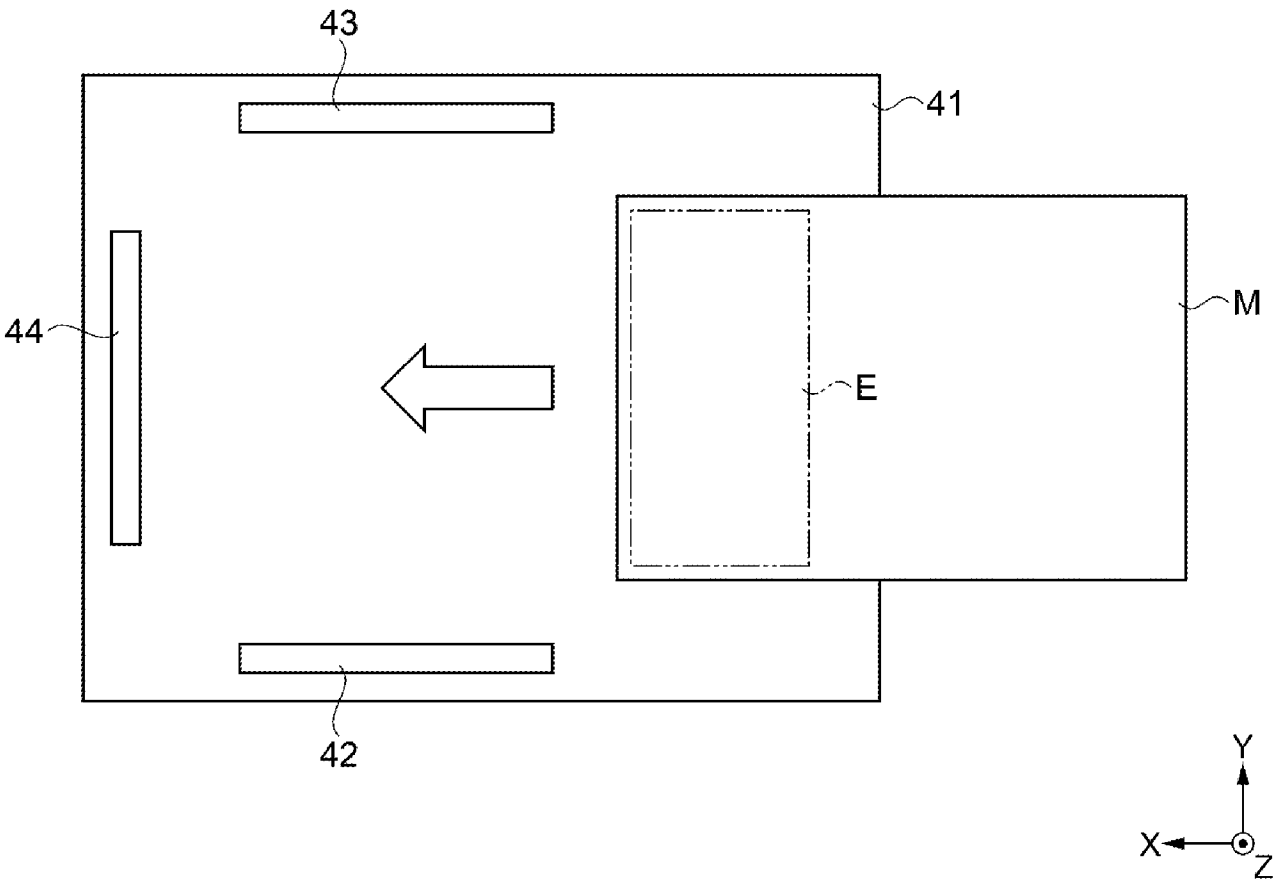
FIG. 11 is an illustrative diagram illustrating control based on a duty distribution.

In the first embodiment, the retraction position P2 is determined based on the duty of each medium M, but the duty for determining the retraction position P2 is not limited to the duty of the entire medium M. For example, the second control unit 45 may determine the retraction position P2 based on the duty within an area of part of the medium M, that is, a duty distribution in the medium M. Specifically, of the medium M discharged in the +X direction toward the loading stand 41, a portion that is downstream, that is, on the +X side first comes into contact with the loading stand 41 or the other medium M on the loading stand 41, and further moves in the +X direction while being in contact therewith. Therefore, the frictional resistance on the +X side, which is downstream, of the medium M greatly affects the ease of the subsequent shift of the medium M. Therefore, the second control unit 45 may determine the retraction position P2, that is, the amount of movement of the regulation units 42, 43, and 44, based on the duty within a region E of a predetermined size downstream of the medium M, as illustrated in FIG. 11.

Figure 12:
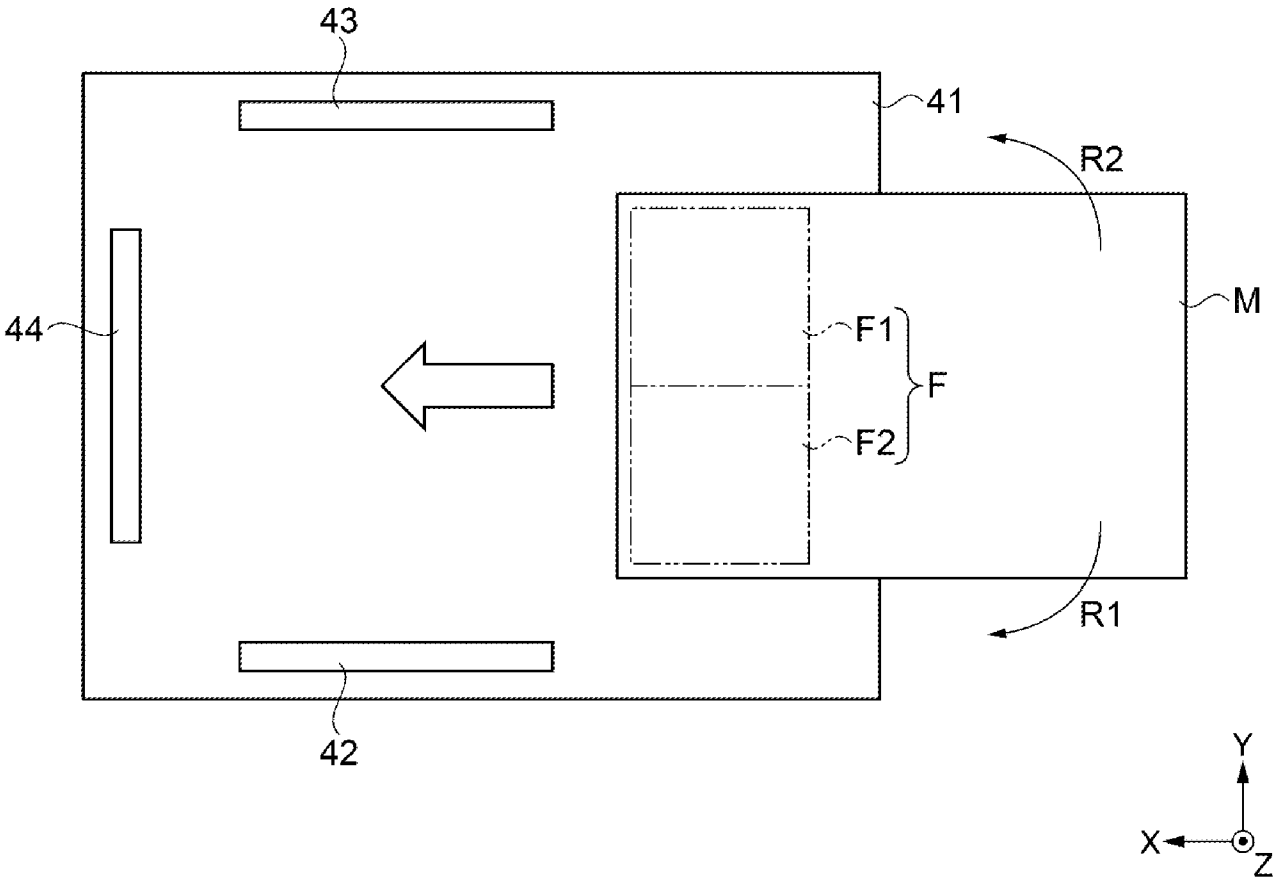
FIG. 12 is an illustrative diagram illustrating control based on the duty distribution.

In each of the embodiments, the amount of movement of the two side end regulation units 42 and 43 is equal to each other, but the amount of movement of the two side end regulation units 42, 43 may be different, based on a distribution of a duty on the medium M or the like. For example, as illustrated in FIG. 12, in a region F downstream of the medium M, a region on the +Y side that is a right side in the discharge direction is defined as a region F1, and a region on the −Y side that is a left side in the discharge direction is defined as a region F2. When a duty of the region F1 is greater than that of the region F2, the frictional resistance of the medium M becomes larger on the +Y side than on the −Y side after the region F of the medium M comes into contact with the loading stand 41 or the other medium M on the loading stand 41. Therefore, it is easy for the medium M to rotate in an R1 direction that is a clockwise direction with the region F1 as a rotation axis. In this case, for a displacement of the medium M in the ±Y direction, the displacement in the −Y direction is made larger than the displacement in the +Y direction, and thus the amount of movement of the side end regulation unit 42 on the −Y side may be made larger than that of the side end regulation unit 43 on the +Y side.

Similarly, when the duty of the region F2 is greater than the duty of the region F1, the frictional resistance of the medium M becomes larger on the −Y side than on the +Y side after the region F of the medium M comes into contact with the loading stand 41 or the other medium M on the loading stand 41. Therefore, it is easy for the medium M to rotate in an R2 direction that is a counterclockwise direction with the region F2 as the rotation axis. In this case, for the displacement of the medium M in the ±Y direction, the displacement in the +Y direction is made larger than the displacement in the −Y direction, and thus the amount of movement of the side end regulation unit 43 on the +Y side may be made larger than that of the side end regulation unit 42 on the −Y side.

In the fourth embodiment described above, the second control unit 45 determines the regulation frequency of the regulation units 42, 43, and 44 based on the discharge speed of the medium M, but may determine the regulation frequency based on factors other than the discharge speed. For example, the regulation frequency may be determined based on the size of the medium M. Specifically, when the size of the medium M is small, a time interval at which the medium M is discharged is shorter than when the size of the medium M is large, and thus, a frequency at which heat or noise from the regulation drive unit 48 occurs becomes higher. Therefore, when the size of the medium M is small, heat or noise from the regulation drive unit 48 may be suppressed by reducing the regulation frequency, as compared to a case in which the size of the medium M is large. Further, the regulation frequency may be reduced as the interval at which the medium M is discharged becomes shorter, regardless of the size of the medium M.

In each of the embodiments described above, sharing of the control of the first control unit 22 and the second control unit 45 is not limited to the above. For example, in each of the above embodiments, the first control unit 22 may perform part of the control performed by the second control unit 45, or the second control unit 45 may also perform part of the control performed by the first control unit 22. Alternatively, the second control unit 45 may not be included, and all the controls may be performed by the first control unit 22. In this case, the first control unit 22 may be included in the printing device 2 or may be included in the medium discharge device 4. Alternatively, the first control unit 22 may be provided outside the printing device 2 and the medium discharge device 4.

In each of the above embodiments, the second control unit 45 may determine the retraction position P2 of the regulation units 42, 43, and 44 based on the thickness of the medium M, but may determine the retraction position P2 based on a material, weight, or the like of the medium M, in addition to the thickness. Thus, the second control unit 45 may determine the retraction position P2 based on the type of the medium M, such as a thickness, material, or weight of the medium M. According to this configuration, even when the ease of the shift of the medium M on the loading stand 41 changes depending on the type of the medium M, it is possible to determine the retraction position P2 of the regulation units 42, 43, and 44 to be an appropriate position.

In each of the above embodiments, an example in which the distance D between the regulation position P1 and the retraction position P2 is divided into four levels based on the thickness, the duty, discharge speed, or the like of the medium M has been illustrated, but the number of levels of the distance D may be smaller than 4 or may be 5 or more. The same applies to a level of regulation frequency.

In the second embodiment, the retraction position P2 is determined based on whether the duty of the lower side is higher than the duty of the upper side, but the retraction position P2 may be determined based on whether the difference between the duty of the lower side and the duty of the upper side is equal to or greater than a predetermined value.

In the above embodiment, the printing device 2 may be a device that ejects another liquid other than the ink. Further, the printing head 20 is not limited to a line head, and may be configured to eject the ink over the entire area in the width direction of the medium M by ejecting liquid while moving in the ±Y direction.

In the second embodiment, the printing device 2 is not limited to a liquid ejection device, that is, an inkjet printing device. For example, a thermal type, a dot impact type, or a laser type may be used.

In each of the embodiments, the medium discharge device 4 is configured as a separate device from the printing device 2, but may be configured integrally with the printing device 2. Further, in the embodiment, the medium discharge device 4 can be loaded with the medium M discharged from one printing device 2, but may be configured to be coupled to a plurality of printing devices and to be loaded with the media M discharged from the plurality of printing devices. Further, the medium discharge device 4 is not limited to a configuration in which the medium M discharged from the printing device 2 is loaded, and the medium M discharged from a processing device that performs processing other than the printing on the medium M or a conveyance device that conveys the medium M without performing processing on the medium M may be loaded.

What is claimed is:

1. A medium discharge device comprising:

a loading stand configured to be loaded with a medium onto which a liquid was ejected by a liquid ejection device;

a plate-like regulation unit configured to move between a regulation position at which a position of the medium discharged to the loading stand is regulated and a retraction position retracted from the regulation position; and a control unit configured to control the movement of the regulation unit, wherein the control unit determines the retraction position, based on an amount of the liquid ejected onto the medium by the liquid ejection device.

2. The medium discharge device according to claim 1, wherein the control unit sets a distance between the regulation position and the retraction position to a first distance when the amount of the liquid ejected onto the medium is a first ejection amount, and sets the distance between the regulation position and the retraction position to a second distance shorter than the first distance when the amount of the liquid ejected is a second ejection amount larger than the first ejection amount.

3. The medium discharge device according to claim 1, wherein the control unit determines the retraction position based on a type of the medium.

4. The medium discharge device according to claim 1, wherein the control unit determines the retraction position based on a difference between an amount of the liquid ejected onto a first side of the medium and an amount of the liquid ejected onto a second side opposite to the first side.

5. The medium discharge device according to claim 4, wherein the first side is a side directed upward on the loading stand, the second side is a side directed downward on the loading stand, and when the amount ejected onto the second side is larger than the amount ejected onto the first side, the control unit makes the distance between the regulation position and the retraction position larger than when the amount ejected onto the second side is equal to or smaller than the amount ejected onto the first side.

6. The medium discharge device according to claim 1, wherein the control unit determines the retraction position based on a distribution of the amount of the liquid ejected onto the medium.

7. The medium discharge device according to claim 1, wherein on the loading stand, the regulation unit is disposed in a discharging direction in which the medium is discharged, relative to a position at which the medium is loaded.

8. The medium discharge device according to claim 1, wherein on the loading stand, the regulation unit is disposed in a direction orthogonal to a discharging direction in which the medium is discharged, relative to a position at which the medium is loaded.

9. A control method for a medium discharge device including a loading stand configured to be loaded with a medium onto which a liquid was ejected by a liquid ejection device, and a plate-like regulation unit configured to move between a regulation position at which a position of the medium discharged to the loading stand is regulated and a retraction position retracted from the regulation position, the control method comprising:

determining the retraction position, based on an amount of the liquid ejected onto the medium by the liquid ejection device.

10. A control method for a medium discharge device including a loading stand configured to be loaded with a medium, and a plate-like regulation unit configured to move between a regulation position at which a position of the medium discharged to the loading stand is regulated and a retraction position retracted from the regulation position, the control method comprising:

determining the retraction position, based on a discharge speed of the medium discharged to the loading stand, and determining a regulation frequency at which the regulation unit is moved from the retraction position to the regulation position, based on the discharge speed of the medium.

11. A medium discharge device comprising:

a loading stand configured to be loaded with a medium;

a plate-like regulation unit configured to move between a regulation position at which a position of the medium discharged to the loading stand is regulated and a retraction position retracted from the regulation position; and a control unit configured to control the movement of the regulation unit, wherein the control unit determines the retraction position, based on a discharge speed of the medium discharged to the loading stand, and the control unit determines a regulation frequency at which the regulation unit is moved from the retraction position to the regulation position, based on the discharge speed of the medium.

12. The medium discharge device according to claim 11, wherein the control unit sets a distance between the regulation position and the retraction position to a third distance when the discharge speed is a first speed, and sets the distance between the regulation position and the retraction position to a fourth distance shorter than the third distance when the discharge speed is a second speed lower than the first speed.

13. The medium discharge device according to claim 11, wherein the control unit sets the regulation frequency to a first frequency when the discharge speed is a first speed, and sets the regulation frequency to a second frequency lower than the first frequency when the discharge speed is a second speed higher than the first speed.

* * * * *